US006644008B2

(12) United States Patent
Rosenwasser et al.

(10) Patent No.: US 6,644,008 B2
(45) Date of Patent: Nov. 11, 2003

(54) CROSS-SECTIONAL SHAPES FOR HOLLOW LINK CHAIN

(75) Inventors: David Rosenwasser, Demerest, NJ (US); Avraham Moshe Rosenwasser, 59 Everette Rd., Demerest, NJ (US) 07627

(73) Assignee: Avraham Moshe Rosenwasser, Norwood, NJ (US)

( * ) Notice: Subject to any disclaimer, the term of this patent is extended or adjusted under 35 U.S.C. 154(b) by 0 days.

(21) Appl. No.: 10/266,107

(22) Filed: Oct. 7, 2002

(65) Prior Publication Data

US 2003/0029156 A1 Feb. 13, 2003

Related U.S. Application Data

(63) Continuation of application No. 09/505,511, filed on Feb. 17, 2000, now Pat. No. 6,460,323.

(51) Int. Cl.[7] ..... B21L 5/02
(52) U.S. Cl. ..... 59/80; 59/83; 59/35.1
(58) Field of Search ..... 59/3, 80, 83, 35.1

(56) References Cited

U.S. PATENT DOCUMENTS 5,185,995 A 2/1993 Dal Monte
5,285,625 A 2/1994 Ofrat et al.
5,361,575 A 11/1994 Rozenwasser
5,452,572 A 9/1995 Alvaro et al.
5,471,830 A 12/1995 Gonzales
5,531,065 A 7/1996 Rozenwasser
5,535,583 A * 7/1996 Holzer et al. ..... 59/35.1
5,537,812 A 7/1996 Rozenwasser
5,660,036 A 8/1997 Rozenwasser
5,797,258 A * 8/1998 Strobel et al. ..... 59/35.1
5,966,922 A * 10/1999 Cossio ..... 59/35.1
6,223,516 B1 5/2001 Falcon et al.
6,237,318 B1 5/2001 Kahan
6,460,323 B1 * 10/2002 Rosenwasser et al. ..... 59/80

* cited by examiner

*Primary Examiner*—David B. Jones
(74) *Attorney, Agent, or Firm*—Katten Muchin Zavis Rosenman

(57) ABSTRACT

A chain link of hollow construction and substantially uniform thickness, for intertwining with other chain links to form a jewelry chain, has a non-annular cross-section throughout the link with the cross-section being symmetric along a centerline plane through said cross-section. The cross-sectional shape of the link preferably has on each side of the centerline plane, at least two sides that meet at a point of inflection. On each side of the centerline plane, at least one side preferably converges toward said centerline plane. A reduction in manufacturing costs and precious metal used to form the links and therefore the chain is realized by using a non-annular cross-section having such constructional qualities.

15 Claims, 5 Drawing Sheets

CROSS-SECTIONAL SHAPES FOR HOLLOW LINK CHAIN

CROSS-REFERENCES TO RELATED APPLICATIONS

This application is a continuation of U.S. application Ser. No. 09/505,511, filed Feb. 17, 2000, now U.S. Pat. No. 6,460,323.

FIELD OF THE INVENTION

This invention relates generally to hollow link jewelry chain, and more particularly to hollow links having unique cross-sectional shapes not seen before in the art.

BACKGROUND OF THE INVENTION

Jewelry chains, and in particular jewelry rope chains, are conventionally formed from solid or hollow annular links having cross-sections that are also annular in configuration. Such links are also conventionally toroidal in configuration, which when combined with an annular cross-sectional configuration results in a link having the shape of a doughnut.

Chain links having non-annular cross-sectional configurations are also known, as shown for example in U.S. Pat. No. 5,537,812 to Rozenwasser. The Rosenwasser '812 links have a cross-section defined by a hollow base portion of generally uniform wall thickness and at least one reinforcing rib portion joined on the base portion and protruding beyond the base portion about the entire circumference of the link. A high luster surface may be achieved by removing the rib portion along certain selected portions of the '812 links, particularly during the faceting operation. Non-traditional cross-sections are also discussed in U.S. Pat. No. 5,285,625 to Ofrat et al. The Ofrat et al. reference, however, focuses on non-standard cross-sections of solid links and hollow links having an annular cross-sectional configuration.

In a continuing effort to reduce the material costs involved in manufacturing jewelry chains while still maintaining an aesthetically pleasing appearance, the present inventor has recognized that a hollow link having an annular configuration has a certain material cross-sectional area defined by $B(r_2^2-r_1^2)$, where $r_2-r_1$ designates the thickness of the sheet of material used to form the link. Normally, hollow links are provided with seams through which a metal former may be dissolved, with the metal former being used to prevent deformation of the link sidewalls during the link creation process. When the seam is rather minimal, as is the case with most prior art chain links, the cross-sectional surface area will approach that of a seamless, annular cross-section hollow link, or $B(r_2^2-r_1^2)$. When the seam is rather substantial, the cross-sectional surface area will be defined as $B(r_2^2-r_1^2)$ minus the seam. The larger the size of the seam, the greater the rate at which the metal former dissolves therethrough.

Taking the above-referenced hollow link having an annular cross-section and a certain sheet thickness, any link having the same sheet thickness and a non-annular cross-section about which the annular cross-section of such annular link could be circumscribed would require less material than the link having an annular cross-section. In other words, if an annular cross-sectional configuration can be circumscribed about a non-annular cross-sectional configuration, with both cross-sectional configurations having the same sheet thickness, the non-annular cross-sectional configuration will inherently use less material than the annular cross-sectional configuration. Likewise, for any straight line, a circular arc connecting those same two end points would have a greater length and for a uniform thickness, a greater area.

Significant advances in the jewelry chain art are defined by the look of the resultant product and the method of making the same. Hollow-link chains advanced the art over solid-link chains by producing a chain with a similar appearance at a fraction of the cost. Consequently, great attention has been paid to the method of manufacturing and forming the links that are intertwined into jewelry chains, with improvements or enhancements in each link resulting in a chain that is, on the whole, improved or enhanced over the prior art.

In an effort to produce a chain that is an improvement over the prior art, the present inventor has devised a way to produce a chain with a reduction in the amount of material used to form the links. The present inventor accomplishes such task by forming links from a wire or a sheet of material having a uniform thickness throughout, and with the resultant link having a non-annular cross section. Such cross-section of the link will also preferably be symmetric about a vertical, centerline plane or axis and, preferably on each side of the centerline plane, have at least two sides that meet at a point of inflection, or the location characterized by the change of direction from the first side to the second side. In some embodiments, each half of the centerline plane will have at least one side converging toward the centerline plane. Such configurations further reduce the extent of the cross-section material of the link with respect to prior art annular, cross-sectional counterpart.

OBJECTS OF THE INVENTION

It is an object of the present invention, therefore, to provide a jewelry chain formed from links with a non-annular cross-section throughout.

It is a further object of the present invention to provide a jewelry chain formed from links with a non-annular cross-section of uniform thickness.

It is a still further object of the present invention to provide a jewelry chain formed from links with a non-annular cross-section that is symmetric along a centerline plane.

It is a still further object of the present invention to provide a jewelry chain formed from links with a non-annular cross-section, that is symmetric along a centerline plane and on each side of the centerline plane there are at least two side walls that meet at an inflection point.

It is a still further object of the present invention to provide a jewelry chain formed from links with a non-annular cross-section, that is symmetric along a centerline plane and on each side of the centerline plane there is at least one side that converges toward such centerline plane.

It is a still another object of the present invention to provide a jewelry chain formed from links with a non-annular cross-section, where such chain is formed from less precious metal than if the links were annular in cross-section.

Still other objects and advantages of the invention will become clear upon review of the following detailed description in conjunction with the appended drawings.

SUMMARY OF THE INVENTION

A chain link of hollow construction and substantially uniform thickness throughout, for intertwining with other chain links to form a jewelry chain, has a non-annular cross-section that is symmetric along a centerline plane through said cross-section. The cross-sectional shape of the link preferably has on each side of the centerline plane, at least two side walls that meet at an inflection point. On each side of the centerline plane, at least one side preferably converges toward said centerline plane. The link of the invention is constructed from less material than a similar counterpart hollow link having an annular cross-section, without sacrificing the aesthetic appeal of such link. Thus, a chain formed from the non-annular-cross-sectional links of the invention will use less material than if such chain were formed from links having an annular cross-section, which results in a reduction in manufacturing cost and an equivalent reduction in the cost to the consumer.

DETAILED DESCRIPTION OF THE PREFERRED EMBODIMENTS

Figure 1:
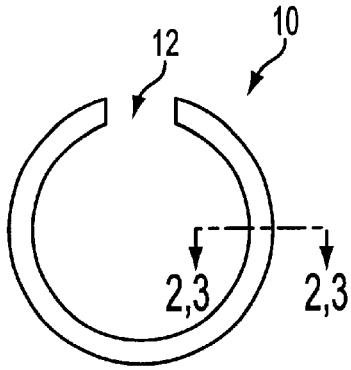
FIG. 1 (PRIOR ART)
FIG. 1 is a front view.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention. In the various views of the drawings, like reference characters designate like or similar parts.

Figure 2:
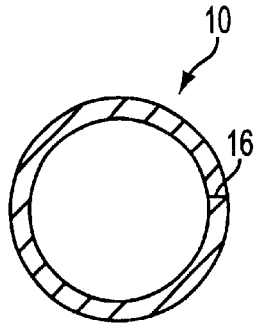
FIG. 2 (PRIOR ART)
FIGS. 2–3 are alternative cross-sectional views of a prior art hollow chain link having an annular cross-section.
Figure 3:
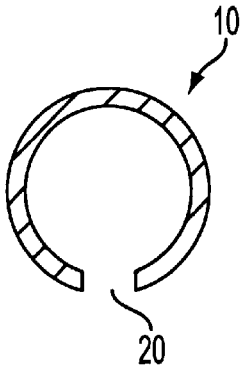
FIG. 3 (PRIOR ART)

FIG. 1 is a front view and FIGS. 2,3 are alternative cross-sectional views of a prior art chain link 10 of hollow construction, said link 10 having a gap 12 for intertwining with other links to form a jewelry chain. Link 10 has an annular cross-section and a uniform thickness 16, and may or may not have a seam section 20 (FIG. 3), through which a metal former (not shown) would dissolve as is known in the art and described above.

Figure 4:
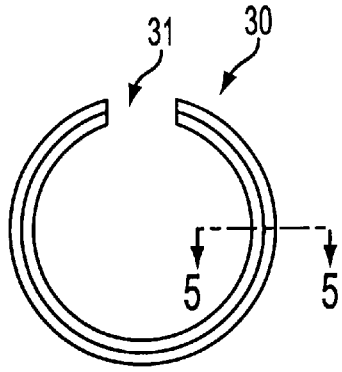
FIG. 4 is a front view and FIG. 5 is a cross-sectional view of a chain link of the invention having a non-annular cross-section.
Figure 5:
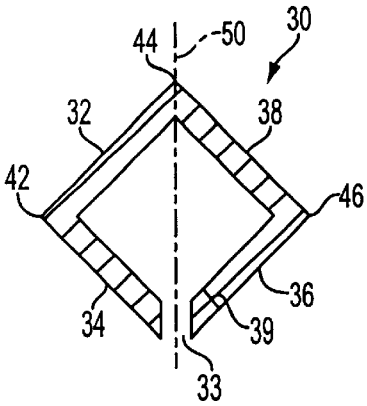
Figure 20:
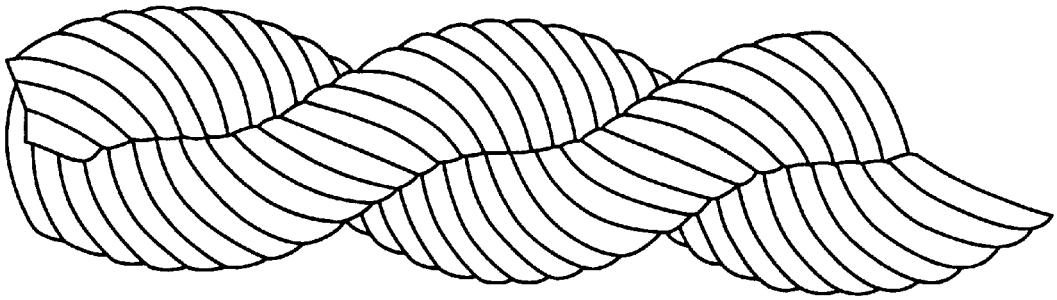
FIG. 20 is an illustrative view of a jewelry chain formed from the links having the cross-sectional shapes of the present invention.

FIG. 4 is a front view and FIG. 5 is a cross-sectional view of a link 30 having a uniform thickness 39, a gap 31 for intertwining with other links to form a jewelry chain (see, for example, FIG. 20) and a seam 33 for the dissolving of a metal former as described above. The non-annular cross-section of link 30 is symmetric along centerline plane 50, having sides 32 and 34 that meet at an inflection point 42 on one side of such plane 50, and sides 36,38 that meet at an inflection point 46 on the other side of such plane 50. Both inflection points 42 and 46 are at the outermost ends of the cross-section with respect to the centerline plane 50. Sides 32 and 38 converge at point 44 along the plane 50, while sides 34 and 36 also converge toward the centerline plane 50 but do not meet at a point due to the seam section 33.

Figure 6:
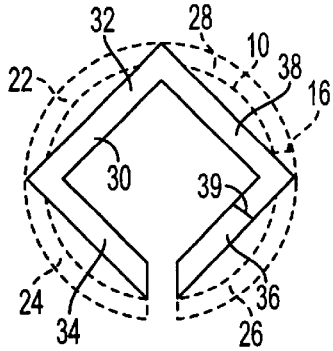
FIG. 6 is a juxtaposition of the cross-sections of FIGS. 3 and 5 for purposes of illustrating the savings in material between the cross-section of the link of the invention and the cross-section of the link of the prior art.
Figure 5A:
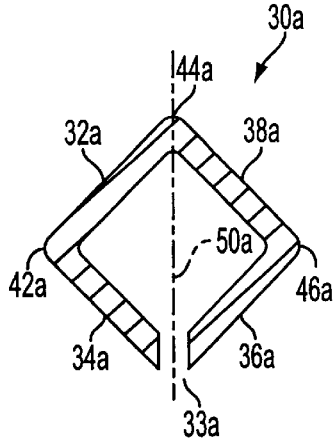
FIG. 5A is a cross-sectional view of an alternative embodiment of the cross-section of the link shown in FIG. 5, and FIGS. 5B–5AA are cross-sectional views of alternative embodiments of a chain link of the invention having cross-sectional sidewalls that meet at fillet-type junctions or points of inflection.
Figure 5B:
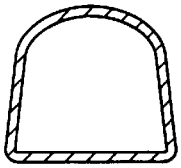
Figure 5C:
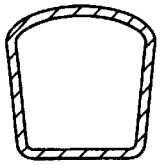
Figure 5D:
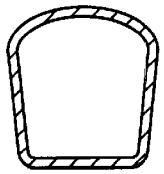
Figure 5E:
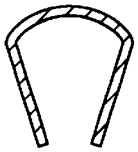
Figure 5F:
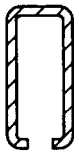
Figure 5G:
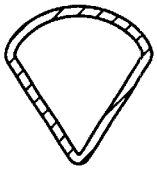
Figure 5H:
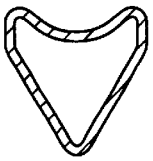
Figure 5I:
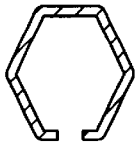
Figure 5J:
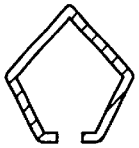
Figure 5K:
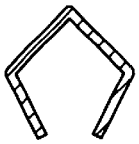
Figure 5L:
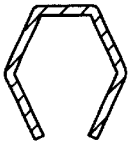
Figure 5M:
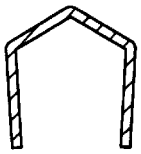
Figure 5N:
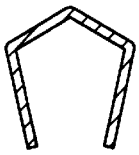
Figure 5O:
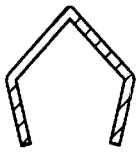
Figure 5P:
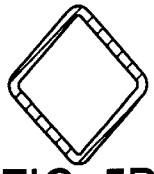
Figure 5Q:
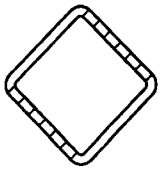
Figure 5R:
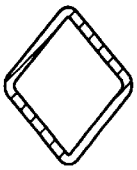
Figure 5S:
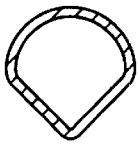
Figure 5T:
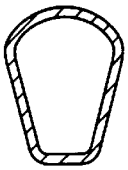
Figure 5U:
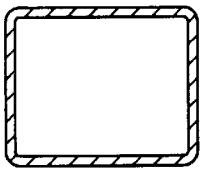
Figure 5V:
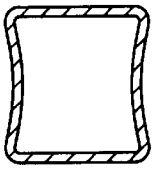
Figure 5W:
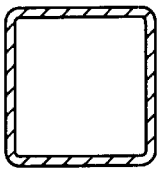
Figure 5X:
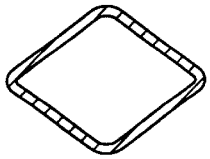
Figure 5Y:
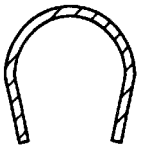
Figure 5Z:
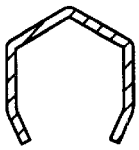
Figure 5A:
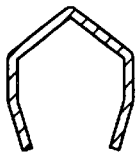

The points 42 and 46 of FIG. 5 are defined as inflection points because they are characterized by the location at which the sides 32,34 and 36,38 change direction with respect to each other. Similarly, point 42 is an inflection point with respect to sides 32 and 38. Such inflection points do not have to be pointed or corners as the case may be, but may be curved or rounded as shown in FIG. 5A. FIG. 5A is a cross-sectional view of an alternative link 30 having a seam 33*a*, where such cross-section is symmetric about a centerline plane 50*a*. On one side of the plane 50*a*, sides 32*a* and 34*a* meet at inflection point 42*a*. On the other side of the plane 50*a*, sides 36*a* and 38*a* meet at inflection point 46*a*. In addition, sides 32*a* and 38*a* converge on inflection point 44*a* on the centerline plane 50*a*, while sides 34*a* and 36*a* do not meet but converge toward the centerline plane 50*a*, and points 42*a* and 46*a* are at the outermost ends of the cross-section with respect to the centerline plane 50*a*. Points 42*a*, 44*a* and 46*a* are not characterized by sharp corners, but are more akin to radius-type fillets present between two angularly displaced objects. Thus, the inflection points discussed herein may be sharp, corner-type junctions as shown for example in the cross-section of FIG. 5, or rounded, radius-type fillets as shown for example in the cross-section of FIG. 5A. FIGS. 5B–5AA are cross-sectional views of various alternative embodiments of a chain link of the invention having fillet-type points of inflection. Such figures are not meant to be exhaustive or limiting in any respect, but are merely illustrative of possible cross-sectional variations constructed in accordance with the scope of the present invention FIG. 6 is a juxtaposition of the cross-sections of FIGS. 3 and 5 (cross-sectional lining omitted for clarity), illustrating the savings in material between the cross-section of the link 30 of the invention and the cross-section of the link 10 of the prior art (shown in phantom). Both links 10 and 30 have the same thickness 16 and 39 respectively. Simple geometry teaches that the linear sides 32,34,36 and 38 of the non-annular cross-sectional link 30 are shorter than their arcuate counterparts 22,24,26 and 28 of the annular cross-sectional link 10 that is circumscribed around such non-annular-cross-sectional link 30. Thus, a savings in material is realized by using the non-annular-cross-sectional link 30 of the present invention instead of the annular-cross-sectional link 10 of the prior art.

Alternative hollow link cross-sections that are symmetric about a centerline plane and on each side of the centerline plane have at least two sides that meet at an inflection point are shown in FIGS. 7 through 19. Such figures are not meant to be exhaustive or limiting in any respect, but are merely illustrative of possible cross-sectional variations constructed in accordance with the scope of the present invention. All cross-sections have a uniform sheet thickness throughout, or what would be characterized as thickness dimension 39 in FIG. 5. Also, while all meeting points are characterized as inflection points as discussed above, which junction locations can be either sharp, curved or rounded, the inflection points discussed below in the various alternative embodiments will be referred to merely as "points," it being understood that such points are inflection points as defined above.

Figure 7:
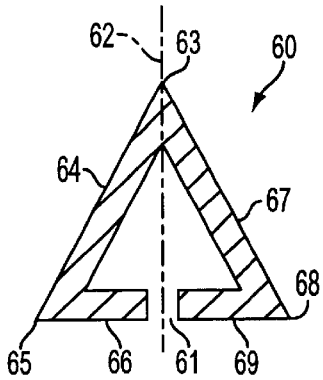

FIG. 7 shows a cross-section of a link 60 with a seam 61, such cross-section being substantially triangular throughout said link 60. The cross-section of link 60 is symmetric about a centerline plane 62. One side of the centerline plane 62 has sides or sidewalls 64 and 66 that meet at point 65 and the other side of the plane 62 has sides or sidewalls 67 and 69 that meet at point 68. Both points 65 and 68 are at the outermost ends on each side of the centerline plane 62 as shown. Converging sides 64 and 67 also meet at point 63 along the centerline plane 62.

Figure 8:
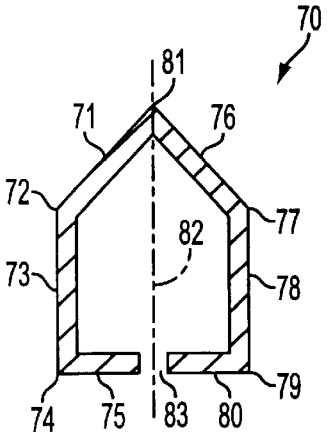

FIG. 8 shows a cross-section of a link 70 with a seam 83, such cross-section being substantially pentagon-shaped throughout said link 70. The cross-section of link 70 is symmetric about a centerline plane 82. One side of the centerline plane 82 has sides 71 and 73 that meet at point 72 as well as sides 73 and 75 that meet at point 74. On the other side of the centerline plane 82, sides 76 and 78 meet at point 77 as well as sides 78 and 80 meet at point 79. In FIG. 8, each side of the centerline plane 82 has two pairs of sides or sidewalls that meet. Points 72 and 74 are at the outermost ends on one side of the centerline plane 82 and points 77 and 79 are at the outermost ends of the other side of the centerline plane 82. Sides 71 and 76 converge toward each other and also meet at point 81 along the centerline plane 82.

Figure 9:
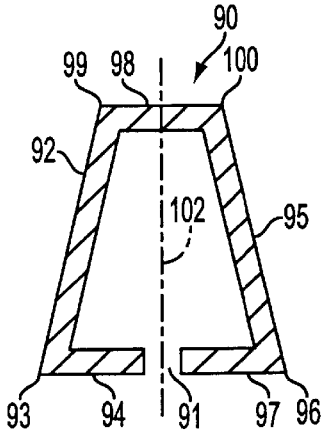

FIG. 9 shows another non-annular cross-section of a link 90 with a seam 91. The cross-section of link 90 is symmetric about a centerline plane 102. One side of the centerline plane 102 has sides 92 and 94 that meet at point 93. On the other side of the centerline plane 102, sides 95 and 97 meet at point 96. In addition, sides 92 and 98 on one side of the centerline plane 102 meet at point 99, and sides 95 and 98 on the other side of the centerline plane 102 meet at point 100. Points 93 and 96 are at the outermost ends of the cross-section with respect to the centerline plane 102. Points 99 and 100 are at the innermost points with respect to said plane 102. Sides 92 and 95 converge toward the centerline plane 102.

Figure 10:
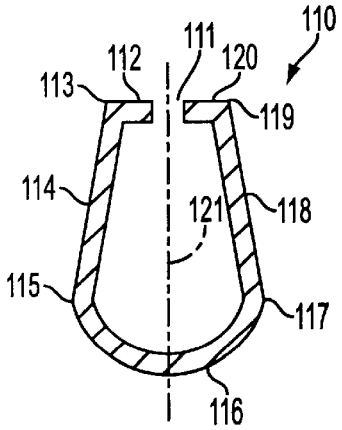

FIG. 10 shows a substantially horseshoe-shaped cross-section of a link 110 with a seam 111. The cross-section of link 110 is symmetric about a centerline plane 121. On one side of the centerline plane 121, sides 112 and 114 meet at point 113. On the other side of the centerline plane 121, sides 118 and 120 meet at point 119. On one side of the centerline plane 121, arcuate side 116 and side 114 meet at point 115. On the other side of the centerline plane 121, arcuate side 116 and side 118 meet at point 117. Points 115 and 117 are at the outermost ends of the cross-section with respect to the centerline plane 121. Points 113 and 119 are at the innermost points with respect to said plane 121. Sides 114 and 118 converge toward the centerline plane 121.

Figure 11:
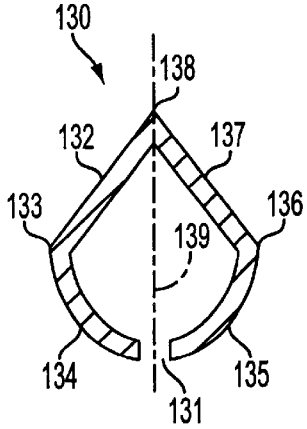

FIG. 11 shows a substantially tear drop-shaped cross-section of a link 130 with a seam 131. The cross-section of link 130 is symmetric about a centerline plane 139. On one side of the centerline plane 139, side 132 and curved 134 meet at point 133. On the other side of the centerline plane 139, curved side 135 and side 137 meet at point 136. Sides 132 and 137 converge toward the centerline plane 139 and meet at point 138. Points 133 and 136 are at the outermost ends of the cross-section with respect to centerline plane 139.

Figure 12:
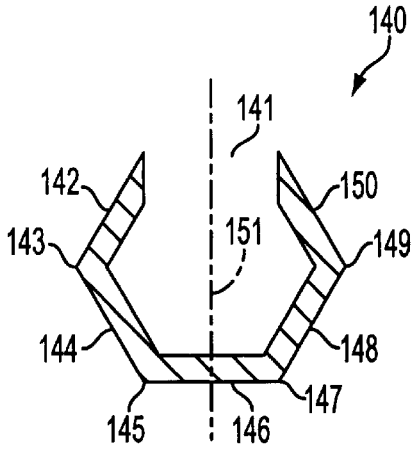

FIG. 12 shows another non-annular cross-section of a link 140 with an enlarged, substantially open seam 141. The cross-section of link 140 is symmetric about a centerline plane 151. On one side of the centerline plane 151, sides 142 and 144 meet at point 143. On the other side of the centerline plane 151, sides 148 and 150 meet at point 149. In addition, side 144 and side 146 on one side of the centerline plane 151 meet at point 145, while side 148 and side 146 on the other side of the centerline plane 151 meet at point 147. Points 143 and 149 are at the outermost ends of the cross-section with respect to the centerline plane 151. Points 145 and 147 are at the innermost points with respect to said plane 151. Sides 142 and 150 converge toward the centerline plane 151, but do not meet.

Figure 13:
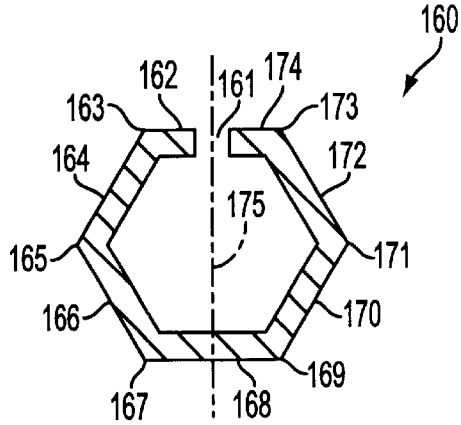

FIG. 13 shows a substantially hexagonally-shaped cross-section of a link 160 with a seam 161. The cross-section of link 160 is symmetric about a centerline plane 175. On one side of the centerline plane 175, sides 162 and 164 meet at point 163, and sides 164 and 166 meet at point 165. On the other side of the centerline plane 175, sides 170 and 172 meet at point 171, and sides 172 and 174 meet at point 173. In addition, side 166 and side 168 on one side of the centerline plane 175 meet at point 167, while side 170 and side 168 on the other side of the centerline plane 175 meet at point 169. Points 165 and 171 are at the outermost ends of the cross-section with respect to the centerline plane 175. Points 163 and 167 on one side of the centerline plane and points 169 and 173 on the other side of the centerline plane are at the innermost points with respect to said centerline plane 175. Sides 164 and 172, as well as sides 166 and 170 converge toward the centerline plane 175.

Figure 14:
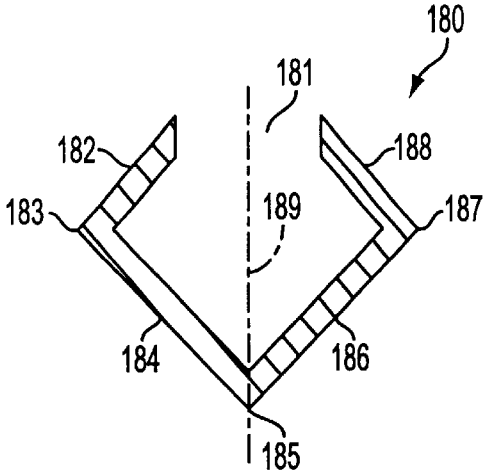

FIG. 14 shows a substantially diamond-shaped cross-section of a link 180 with a substantially open seam portion 181. The cross-section of link 180 is symmetric about a centerline plane 189. On one side of the centerline plane 189, sides 182 and 184 meet at point 183. On the other side of the centerline plane 189, sides 186 and 188 meet at point 187. Sides 184 and 186 converge toward the centerline plane 189 and meet at point 185. Sides 182 and 188 also converge toward the centerline plane 189, but do not meet. Points 183 and 187 are at the outermost ends of the cross-section with respect to the centerline plane 189.

Figure 15:
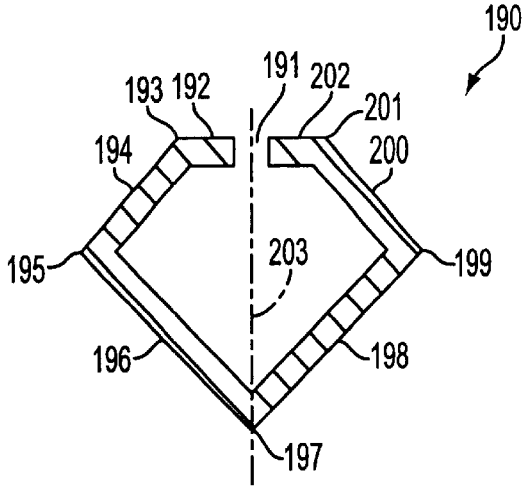

FIG. 15 shows a cross-section of a link 190 with a seam portion 191, such cross-section being substantially gem-shaped throughout said link 190. The cross-section of link 190 is symmetric about a centerline plane 203. On one side of the centerline plane 203, sides 192 and 194 meet at point 193, and sides 194 and 196 meet at point 195. On the other side of the centerline plane 203, sides 198 and 200 meet at point 199, and sides 200 and 202 meet at point 201. Sides 196 and 198 converge toward the centerline plane 203 and meet at point 197 on such plane. Sides 192 and 202 are directed toward the centerline plane 203, but do not meet thereon. Points 195 and 199 are at the outermost ends of the cross-section with respect to the centerline plane 203, while points 193 and 201 are at the innermost ends with respect to such plane 203.

Figure 16:
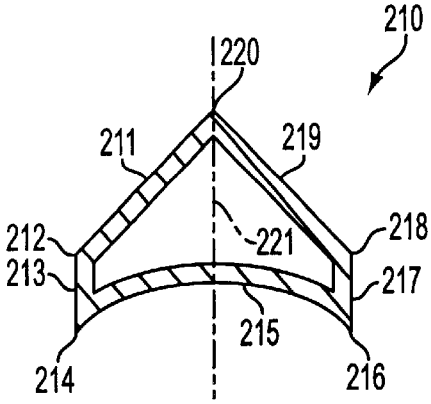

FIG. 16 shows a cross-section of a seamless link 210, such cross-section being non-annular in shape throughout said link 210. The cross-section of link 210 is symmetric about a centerline plane 221. On one side of the centerline plane 221, sides 211 and 213 meet at point 212. On the other side of the centerline plane 221, sides 217 and 219 meet at point 218. In addition, side 213 and side 215 on one side of the centerline plane 221 meet point 214, while side 215 on the other side of the centerline plane and side 217 meet at point 216. Points 212 and 214 on one side of the centerline plane 221, and points 216 and 218 on the other side of the plane 221, are all at the outermost ends of the cross-section with respect to such plane 221. Sides 211 and 219 converge toward the centerline plane 221 and meet at point 220.

Figure 17:
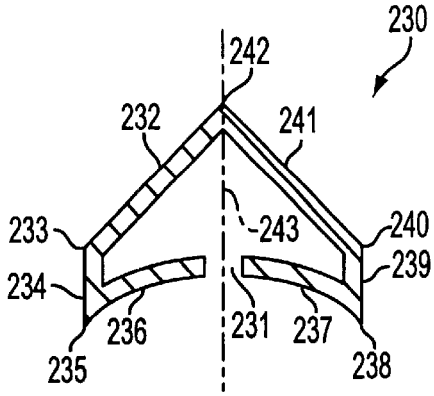

FIG. 17 shows a cross-section of a link 230 having a seam 231, such cross-section being non-annular in shape throughout said link 230. FIG. 17 illustrates a seamed version of the seamless cross-section of FIG. 16. The cross-section of link 230 is symmetric about a centerline plane 243. On one side of the centerline plane 243, sides 232 and 234 meet at point 233, and side 234 and curved side 236 meet at point 235. On the other side of the centerline plane 243, curved side 237 and side 239 meet at point 238, and sides 239 and 241 meet at point 240. Sides 232 and 241 converge toward the centerline plane 243 and meet at point 242 along such plane 243. Sides 236 and 237 are directed toward such plane 243 but do not meet. Points 233 and 235 on one side of the centerline plane 243, and points 238 and 240 on the other side of the centerline plane 243, are all at the outermost ends of the cross-section with respect to the centerline plane 243.

Figure 18:
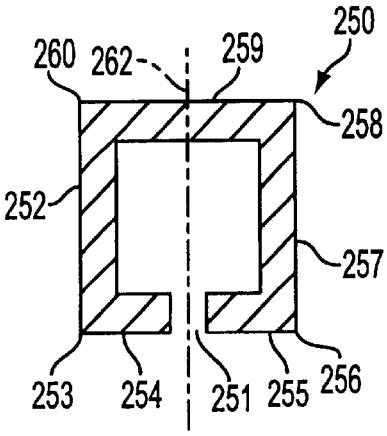
FIGS. 7–19 illustrate alternative hollow link cross-sections of the invention that are symmetric about a centerline plane with each side of the centerline plane having at least two side walls that meet at a point.

FIG. 18 shows a substantially square cross-section of a link 250 having a seam 251. The cross-section of link 250 is symmetric about a centerline plane 262. On one side of the centerline plane 262, sides 252 and 254 meet at point 253. On the other side of the centerline plane 262, sides 255 and 257 meet at point 256. In addition, side 252 and side 259 on one side of the centerline plane 262 meet at point 260, while side 259 on the other side of the centerline plane 262 and side 257 meet at point 258. Points 253 and 260 on one side of the centerline plane 262, and points 256 and 258 on the other side of the centerline plane 262 are all at the outermost ends of the cross-section with respect to the centerline plane 262. Sides 254 and 255 are directed toward the centerline plane 262.

Figure 19:
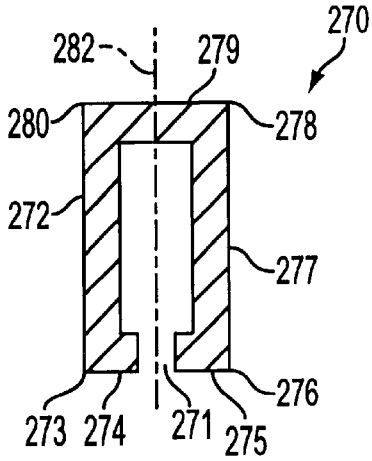

FIG. 19 shows a substantially rectangular cross-section of a link 270 having a seam 271. The cross-section of link 270 is symmetric about a centerline plane 282. On one side of the centerline plane 282, sides 272 and 274 meet at point 273. On the other side of the centerline plane 282, sides 275 and 277 meet at point 276. In addition, side 272 and side 279 on one side of the centerline plane 282 meet at point 280, while side 279 on the other side of the centerline plane 282 and side 277 meet at point 278. Points 273 and 280 on one side of the centerline plane 282, and points 276 and 278 on the other side of the centerline plane 282 are all at the outermost ends of the cross-section with respect to the centerline plane 282. Sides 274 and 275 are directed toward the centerline plane 282.

As noted above, the various alternative cross-sectional embodiments of FIGS. 5–19 are meant to be illustrative only, and not limiting in any sense. Chain links of the present invention having such cross-sections can be intertwined to form a conventional jewelry chain, or a so-called rope chain or the like, as illustrated for example in FIG. 20. Also, such links discussed above could be faceted, either before or after assembly into a jewelry chain, i.e., the links could be pre-faceted and then assembled into a chain, or the chain itself could be faceted, which would, in turn, result in the faceting of individual links. Faceting could occur using the well known ice lathe method, or several dry methods known in the art, where such faceting can occur by deforming or flattening the exterior of the links. Other methods may be used. Thus, a chain formed from links having cross-sectional features or elements in accordance with the present invention will benefit from a reduced cross-sectional area as compared with a chain formed from links having an annular cross-section, and therefore a reduced cost for material, without sacrificing the overall aesthetic look or appeal of such chain.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

We claim:

1. A method of forming a jewelry chain comprising the steps of:

providing a chain link having an inner portion, an outer portion opposite said inner portion, and a cross-section that is non-annular and symmetric along a centerline plane, intertwining said chain link with other chain links to form a jewelry chain, and deforming at least part of said outer portion of at least one of said intertwined chain links such that said deforming does not result in the loss of any link material, said cross-section further comprising a plurality of segments, on each side of the center plane at least two of said segments of said cross-section of which meet at a point of inflection, said cross-section has a substantially uniform thickness throughout, and wherein at least one of said segments is curved.

2. A method in accordance with claim 1, wherein said points of inflection are at outermost ends of said cross-section with respect to said centerline plane.

3. A method in accordance with claim 1, wherein at least two of said segments of said cross-section converge toward said centerline plane.

4. A method in accordance with claim 1, wherein said cross-section is non-U shaped.

5. A rope chain formed by the method of claim 1.

6. A method in accordance with claim 1, wherein said deforming occurs by flattening the exterior surfaces of said chain links.

7. A method in accordance with claim 1, wherein said deforming occurs by using an ice lathe.

8. A method of forming a jewelry chain comprising the steps of:

providing a chain link having an inner portion, an outer portion opposite said inner portion, and a cross-section that is non-annular and symmetric along a centerline plane, intertwining said chain link with other chain links to form a jewelry chain, and deforming at least part of said outer portion of at least one of said intertwined chain links such that said deforming does not result in the loss of any link material, said cross-section further comprising a plurality of segments, on each side of the centerline plane at least two of said segments of said cross-section of which meet at a point of inflection, said cross-section has a substantially uniform thickness throughout, and wherein at least two of said segments of said cross-section converge on said centerline plane.

9. A method in accordance with claim 8, wherein at least two of said segments of said cross-section are directed toward said centerline plane.

10. A method in accordance with claim 8, wherein said cross-section is non-U shaped.

11. A rope chain formed by the method of claim 8.

12. A method in accordance with claim 8, wherein said deforming occurs by flattening the exterior surfaces of said chain links.

13. A method in accordance with claim 8, wherein said deforming occurs by using an ice lathe.

14. A chain link for intertwining with other chain links to form a jewelry chain, said chain link having a non-annular cross-section that is symmetric along a centerline plane, said cross-section further comprising:

a seam portion, a substantially uniform thickness throughout, and a plurality of segments, wherein at least two of said segments of said cross-section meet at a point of inflection, wherein said point of inflection occurs on at least one side of said centerline plane, wherein on each side of the centerline plane there are at least three distinct segments, wherein said seam portion lies on said centerline plane, and wherein at least one of said segments is curved.

15. A chain link for intertwining with other chain links to form a jewelry chain, said chain link having a non-annular cross-section that is symmetric along a centerline plane, said cross-section further comprising:

a seam portion, a substantially uniform thickness throughout, and a plurality of segments, wherein at least two of said segments of said cross-section meet at a point of inflection, wherein said point of inflection occurs on at least one side of said centerline plane, wherein on each side of the centerline plane there are at least three distinct segments, wherein said seam portion lies on said centerline plane, and wherein said point of inflection occurs along the centerline plane.

* * * * *